US005195586A

United States Patent [19]

Gambertoglio

[11] Patent Number: 5,195,586

[45] Date of Patent: Mar. 23, 1993

[54] RIGHT-HAND ON AND RIGHT-HAND OFF RETRIEVING HEAD

[75] Inventor: Louis M. Gambertoglio, The Woodlands, Tex.

[73] Assignee: Baker Hughes Incorporated, Houston, Tex.

[21] Appl. No.: 856,117

[22] Filed: Mar. 23, 1992

[51] Int. Cl.[5] ..... E21B 23/00; E21B 31/00

[52] U.S. Cl. ..... 166/240; 166/242

[58] Field of Search ..... 166/240, 242, 330, 331

[56] References Cited

U.S. PATENT DOCUMENTS 4,781,250 11/1988 McCormick et al. ..... 166/240

5,074,361 12/1991 Brisco et al. ..... 166/240 X 5,117,685 6/1992 Goldschild ..... 166/240 X

*Primary Examiner*—Thuy M. Bui

*Attorney, Agent, or Firm*—Melvin A. Hunn; Mark W. Handley

[57] ABSTRACT

A downhole connection is provided which allows downhole releasable coupling between a workstring and a wellbore tool. The downhole connection includes a pin connector affixed to the upper end of the wellbore tool, and a box connector which is part of a retrieving head affixed to the lower end of the workstring. The pin connector has a generally cylindrical exterior surface with two lugs which are laterally disposed and extend radially therefrom. The box connector has an interior cylindrical surface with two continuous combinations of grooves disposed therein to form a track, or pathway, for the two lugs disposed on the exterior surface of the pin connector to matingly engage within to couple the workstring to the wellbore tool. When the box connector and the pin connector are matingly engaged, both torque and axial force may be transmitted from the workstring to the wellbore tool for conveyance and manipulation of the wellbore tool. When the wellbore tool is rigidly affixed within the wellbore, the box connector may be disengaged from the pin connector to uncouple the workstring from the wellbore tool. Both engagement and disengagement between the box connector and the pin connector are accomplished by applying axial force in combination with right-hand torque to the downhole connection, with right-hand torque automatically applied during engagement. Since left-hand torque is not required for either engagement or disengagement of the downhole connection, the risk of unscrewing workstring tubular members is avoided.

18 Claims, 8 Drawing Sheets

RIGHT-HAND ON AND RIGHT-HAND OFF RETRIEVING HEAD

BACKGROUND OF THE INVENTION

1. Field of the Invention

This invention relates to a downhole connection for use in a subterranean wellbore to couple a wellbore tool to a workstring for manipulation and conveyance of the wellbore tool.

2. Description of the Prior Art

Prior art downhole connections have been used to releasably couple a workstring to a wellbore tool as the wellbore tool is disposed downhole inside of a wellbore. Once releasably coupled, the workstring may be used for manipulation and conveyance of the wellbore too. Typically, prior art downhole connections consisted of a retrieving head disposed on the lower end of the workstring, with the retrieving head including a box connector that mates with a pin connector included on the upper end of the wellbore tool.

To couple a typical prior art retrieving head with a wellbore tool, the prior art retrieving head is lowered into the wellbore and over the upper end of the wellbore tool. As the retrieving head is lowered over the upper end of the wellbore tool, the retrieving head is rotated with an engagement rotation to interlock the retrieving head box connector with the wellbore tool pin connector in releasable mating engagement so that torque and upward forces can be transmitted from the workstring, through the retrieving head, and to the wellbore tool. Typically, the engagement rotation to interlock the box connector to the pin connector is right-hand rotation, which automatically occurs as the box connector is lowered over the pin connector.

To uncouple a prior art retrieving head box connector from a wellbore tool pin connector, the retrieving head is lifted while being rotated with a disengagement rotation which is an opposite rotation from the rotation used to interlock the retrieving head box connector with the wellbore tool pin connector. Typically, the disengagement rotation is left-hand rotation, which requires left-hand torque to be applied to the workstring.

A problem arises since workstrings are typically comprised of threaded tubular members which are made up, or connected, by right-hand rotation, and broken down, or separated, by left-hand rotation. So whenever left-hand torque was applied to the workstring to impart left-hand rotation to uncouple prior art retrieving heads from wellbore tool pin connectors, there was always a risk of the threaded tubular members in the workstring unscrewing and being left in the wellbore.

SUMMARY OF THE INVENTION

It is one objective of the present invention to provide a downhole connection having a retrieving head for releasably coupling a workstring to a wellbore tool disposed downhole inside of a wellbore.

It is another objective of the present invention to provide a downhole connection having a retrieving head for releasably coupling a workstring to a wellbore tool in order to manipulate and convey the wellbore tool by transmitting upward pulling forces, downward pushing forces, left-hand torque, and right-hand torque to the wellbore tool.

It is yet another objective of the present invention to provide a downhole connection with a retrieving head for releasably coupling a workstring to a wellbore tool after application of an engagement torque.

It is still another objective of the present invention to provide a downhole connection having a retrieving head which will releasably couple a workstring to a wellbore tool downhole inside of a wellbore, and which may be manipulated to uncouple the workstring from the wellbore tool by applying a disengagement torque in the same direction as the engagement torque to prevent workstring members from unscrewing.

Additional objects, features and advantages will be apparent in the written description which follows. These objectives are achieved as is now described. A downhole connection is provided which includes an inner connector half and an outer connector half. The inner connector half has at least one outwardly protruding member which engages with at least one inwardly protruding member on the outer connector half. The inwardly protruding member on the outer connector half defines at least one continuous groove on the interior of the outer connector half which provides a track, or pathway, for the at least one outwardly protruding member on the inner connector half to matingly engage within for transmitting torque and axial force from the workstring to the wellbore tool. The outer connector half is engaged with the inner connector half, and disengaged from the inner connector half by applying the right-hand torque in combination with axial force In the preferred embodiment of this invention, the inner connector half is affixed to the upper end of a wellbore tool, and the outer connector half is affixed to the bottom of a workstring.

The preferred embodiment of the downhole connection includes a pin connector affixed to the upper end of the wellbore tool, and a box connector which is part of a retrieving head affixed to the lower end of the workstring. The pin connector has a generally cylindrical exterior surface with two lugs which are laterally disposed and extend radially therefrom. The box connector has an interior cylindrical surface with two continuous combinations of grooves disposed therein to form a track, or pathway, for the two lugs disposed on the exterior surface of the pin connector to matingly engage within to couple the workstring to the wellbore tool. When the box connector and the pin connector are matingly engaged, both torque and axial force may be transmitted from the workstring to the wellbore tool for conveyance and manipulation of the wellbore tool. When the wellbore tool is rigidly affixed within the wellbore, the box connector may be disengaged from the pin connector to uncouple the workstring from the wellbore tool. Both engagement and disengagement between the box connector and the pin connector are accomplished by applying axial force in combination with right-hand torque to the downhole connection, with right-hand torque being automatically applied during engagement. Since left-hand torque is not required for either engagement or disengagement of the downhole connection, the risk of unscrewing workstring tubular members is avoided.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE INVENTION

Figure 1:
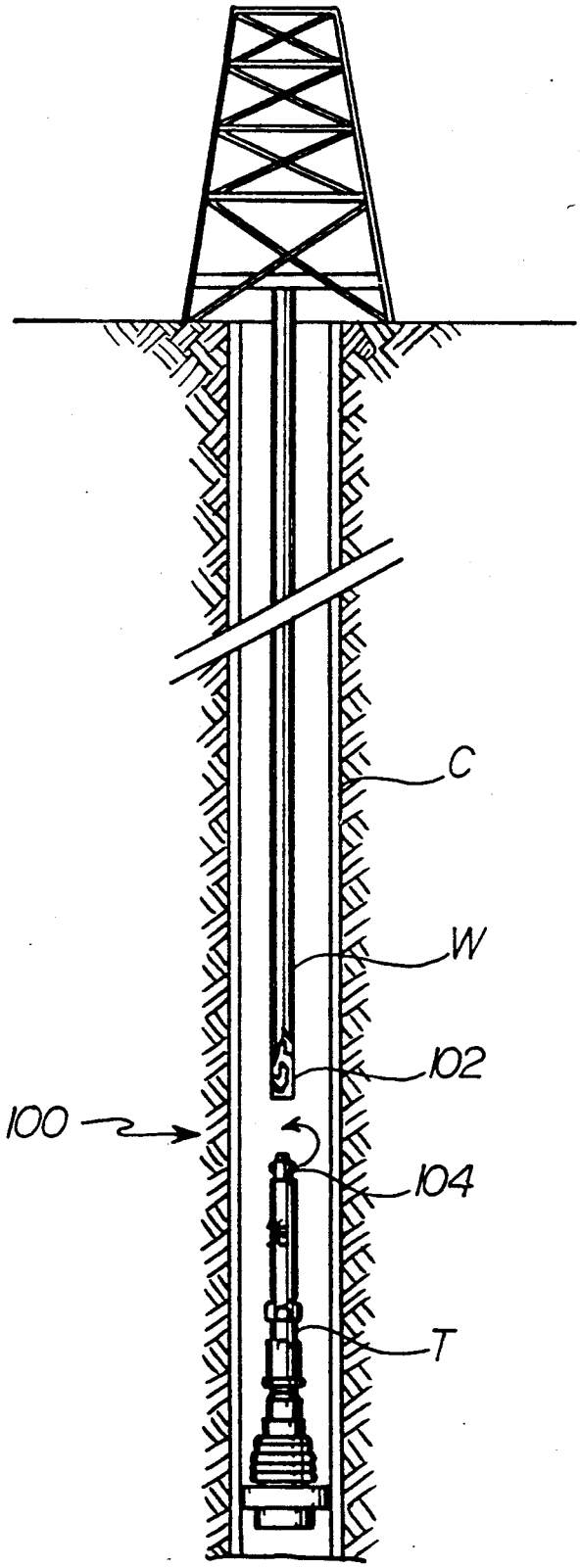
FIG. 1 is a partial longitudinal section view of a wellbore showing the preferred embodiment of the downhole connection of the present invention, with the pin connector disposed on the upper end of a wellbore tool, and with the retrieving head box connector disposed on the lower end of a tubular workstring disengaged from the pin connector so that the workstring is not coupled with the wellbore tool.

With reference now to the figures, and in particular with reference to FIG. 1, a partial longitudinal section view of a wellbore is shown with the preferred embodiment of the downhole connection 100 disposed within, showing pin connector 104 disposed on the upper end of wellbore tool T, and retrieving head box connector 102 affixed to the lower end of tubular workstring W and disengaged from pin connector 104 so that workstring W is not coupled with wellbore tool T. As shown in FIG. 1, box connector 102, which is a female lock piece, can be disengaged from pin connector 104, which is a male lock piece, when wellbore tool T is disposed within the wellbore in a fixed position. From this position, box connector 102 may be lowered over pin connector 104 in order to couple workstring W to wellbore tool T. Once box connector 102 is engaged with pin connector 104, right-hand and left-hand torque may be applied by workstring W to wellbore tool T through downhole connection 100, and both upward and downward axial forces which act to both pull and push wellbore tool T, respectively, may also be applied by workstring W to the wellbore tool T through downhole connection 100.

The terms right-hand and left-hand, as used for both torque and rotation, are herein defined by having right-hand torque and rotation correspond to the direction indicated by applying the right-hand rule of thumb for making up right-hand threaded connections. For example, right-hand torque applied to wellbore tool T urges rotation of wellbore tool T to the right, which would be viewed as clockwise rotation when looking downhole from the ground surface towards wellbore tool T. Left-hand torque applied to wellbore tool T urges rotation of wellbore tool T to the left, which would be viewed as counterclockwise rotation when looking downhole from the ground surface toward wellbore tool T. Also, push forces are herein defined as axial forces which push downward on wellbore tool T, and pull forces are herein defined as axial forces which pull upward on wellbore tool T.

Figure 2A:
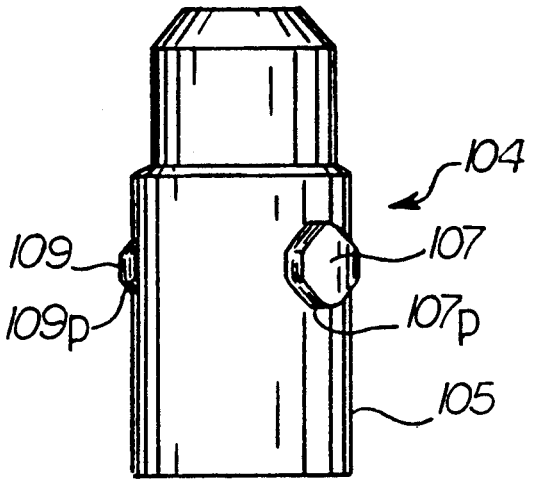
FIG. 2*a* is a perspective view of the preferred embodiment of the pin connector which has two generally diamond shaped lugs laterally disposed on the outer cylindrical surface of the pin connector.

Now with reference to FIG. 2*a*, a perspective view is shown of pin connector 104 which has a cylindrical outer surface 105 with two laterally disposed radially extending outwardly protruding diamond shaped lugs 107 and 109. Pin connector 104 forms a male lock piece for matingly engaging with box connector 102, which forms a female lock piece. Lugs 107 and 109 form outwardly protruding members on pin connector 104.

The generally diamond shape of lugs 107, 109 define peripheral edges 107*p* and 109*p* which serve to locate and guide lugs 107, 109 as they traverse, or travel, through continuous grooves on the inside surface of box connector 102, wherein the continuous grooves, or tracks, provide pathways for lugs 107 and 109 to travel within box connector 102 as box connector 102 is lowered over pin connector 104. These continuous grooves in box connector 102 will be discussed below. Although lug 107 is actually stationary in respect to a frame of reference fixed with respect to the wellbore, relative movement between box connector 102 and pin connector 104 can be phrased in terms of lug 107 traversing within box connector 102. In other embodiments of this invention, lug 107 may be affixed to workstring W and moved with respect to the wellbore, and box connector 102 which may be stationary and affixed to wellbore tool T.

Figure 2B:
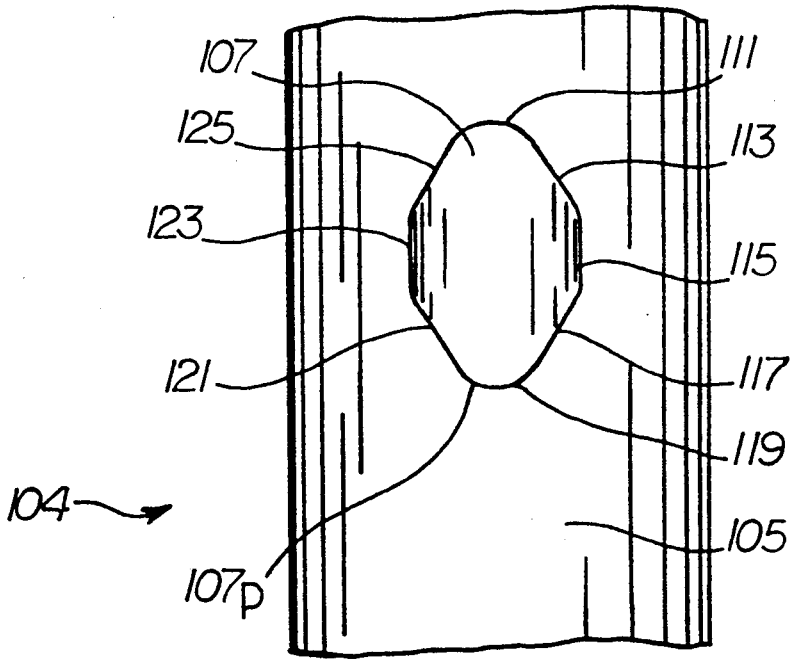
FIG. 2*b* is a side view of the preferred embodiment of the pin connector showing one of the generally diamond shaped lugs disposed on the outer cylindrical surface of the pin connector.

With reference to FIG. 2*b*, a side view is shown of pin connector 104 and diamond shaped lug 107 disposed on outer cylindrical surface 105 of pin connector 104. The peripheral edge 107*p* of lug 107 defines several radially extending surfaces which are labeled as surfaces 111, 113, 115, 117, 119, 121, 123, and 125. These surfaces both locate and guide lug 107 when traversing within a continuous groove of box connector 102, and receive loads when either torque or axial force is applied from workstring W to wellbore tool T. Typically, no more than one lug surface will be contacting box connector 102 for locating and guiding lug 107 within a continuous groove. Also, usually only two or three surfaces will be contacting box connector 102 for transmitting torque and axial force.

For example, lug surfaces 111, 113, and 125 serve as load bearing surfaces for receiving downward axial force transmitted from workstring W to push on wellbore tool T. Lug surfaces 117, 119, and 121 serve as load bearing surfaces for receiving upward axial force transmitted by workstring W to pull on wellbore tool T. Lug surfaces 113, 115, and 117 serve as right-hand torque receiver surfaces which are load bearing surfaces when right-hand torque is applied from workstring W to wellbore tool T to urge wellbore tool T to move to the right, which is a clockwise rotation when viewed looking downhole from the surface towards wellbore tool T. Lug surfaces 121, 123, and 125 serve as left-hand torque receiver surfaces which are load bearing surfaces when left-hand torque is applied from workstring W to wellbore tool T to urge wellbore tool T to move to the left, which is a counterclockwise direction when viewed from the surface looking downhole towards wellbore tool T.

Still with reference to FIG. 2*b*, lug surfaces 111, 113, 115, 123, and 125 serve to guide movement of lug 107 as it traverses upward within the grooved inner surface of box connector 102, with lug 107 movement defined with respect to box connector 102 as box connector 102 is lowered over pin connector 104. Lug surfaces 121, 123, and 125 serve to guide movement of lug 107 within the grooved inner surface of box connector 102 as box connector 102 is rotated to the left. Lug surfaces 115, 117, 119, 121, and 123 serve to guide movement of lug 107 within the grooved inner surface of box connector 102 as box connector 102 is moved uphole. Lug surfaces 113, 115, and 117 serve to guide movement of lug 107 within the grooved inner surface of box connector 102 as box connector 102 is rotated to the right.

Figure 3:
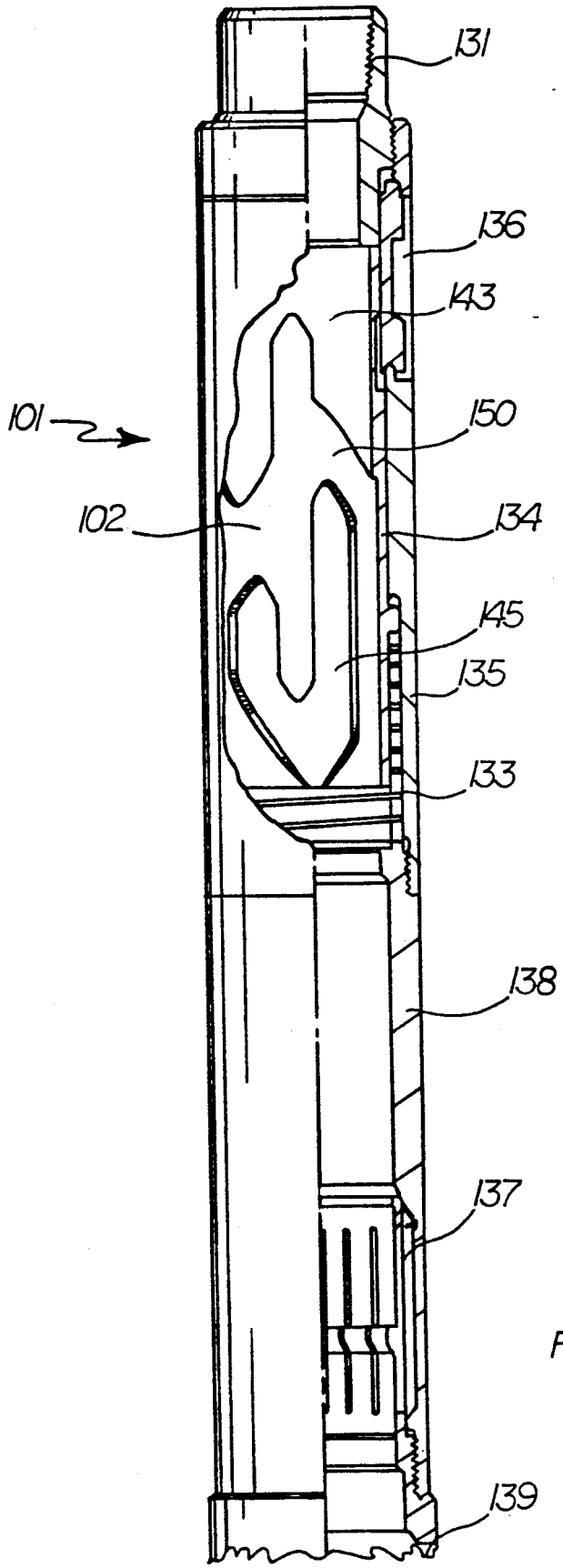
FIG. 3 is a fragmentary partial longitudinal section view of a retrieving head showing the preferred embodiment of the box connector disposed therein.

Referring to FIG. 3, a fragmentary partial longitudinal section view is shown of a retrieving head 101 with the preferred embodiment of the box connector 102 disposed therein. As shown in FIG. 3, retrieving head 101 includes: a box connector 102; an upper housing 135, an inner housing 134, a lower housing 138, threads 131, snap sleeve 137, mill shoe 139, key 136, and ratchet spring assembly 133. Threads 131 are for affixing retrieving head 101 to workstring W. Snap sleeve 137 engages with a set of radially extending collets on the wellbore tool (not shown) to provide an actuation mechanism to operate wellbore tool members such as a valve. Mill shoe 139 is used for clearing off debris that may become lodged on top of wellbore tool T so that box connector 102 may be lowered over pin connector 104 to couple workstring W to wellbore tool T.

Prior to lowering retrieving head 101 into the wellbore, key 136 may be installed in either a locked or an unlocked position. When key 136 is in an unlocked position, box connector 102 can be rotated within housing 135 so that retrieving head 101 can be rotated with respect to wellbore tool T when box connector 102 is engaged with pin connector 104. This allows mill shoe 139 to be rotated for cleaning debris off the top of the wellbore tool when washing the top of the wellbore tool will not remove the debris. When key 136 is in a locked position, box connector 102 is rigidly positioned within retrieving head 101 and mill shoe 139 can not be freely rotated with respect to the wellbore tool when box connector 102 is engaged with pin connector 104. Ratchet spring assembly 133 allows ratcheting of box connector 102 during engagement with pin connector 104 when key 136 is in the unlocked position. Ratchet spring assembly 133 acts in combination with a helical head (not shown) to allow rotation of the retrieving head in only one direction when pin connector 104 is mated with box connector 102 and key 136 is in the unlocked position.

Also shown in FIG. 3 on the backside on the interior of inner cylindrical housing 134 are inserts 145 and 143. The interior surface of inner cylindrical housing 134, and the peripheral edges of inserts 143 and 145 together define a continuous groove 150 which provides a track, or pathway, for one of the lugs of pin connector 104, lugs 107, 109 shown in FIG. 2*b*, to traverse and interlock with in order for box connector 102 to matingly engage pin connector 104 so that axial forces and torque may be transmitted from workstring W to wellbore tool T. It should be noted that there is also a third insert, insert 146 (not shown in FIG. 3), which is circumferentially disposed on the inside surface of inner cylindrical housing 134 180° from insert 145, and which defines a portion of a second continuous groove 160 (not shown in FIG. 3), which is circumferentially disposed within housing 134 180° from continuous groove 150.

Figure 4:
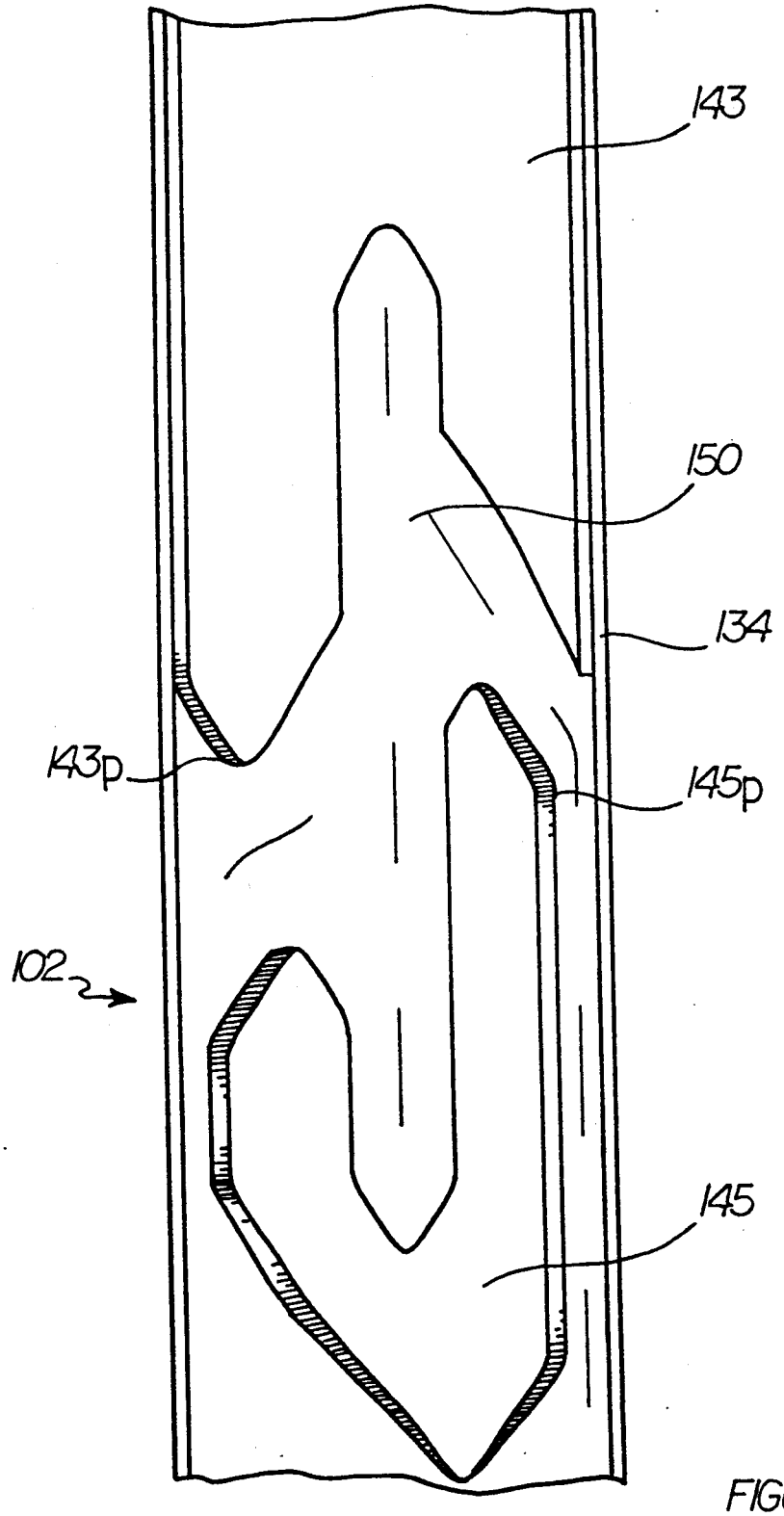
FIG. 4 is an enlarged fragmentary longitudinal section view showing the grooved interior of the preferred embodiment for the box connector used in the downhole connection of the present invention.

FIG. 4 is an enlarged fragmentary longitudinal section view showing the grooved interior of the preferred embodiment construction for box connector 102. The peripheral edges 143*p* and 145*p* of insert 143 and 145 define continuous groove 150 on the interior surface of inner cylindrical housing 134, which in turn define tracks, or pathways, through which one of the lugs 107, 109 on pin connector 104 can traverse to bring box connector 102 into mating engagement with pin connector 104 to couple workstring W to wellbore tool T for transmitting axial force and torque therebetween. Inserts 143 and 145 are inwardly protruding members of box connector 102. It should again be noted that a third insert, insert 146 (not shown in FIG. 4), defines a portion of a second continuous groove 160 (not shown in FIG. 4) which is circumferentially disposed inside of inner housing 134 180° from continuous groove 150.

Figure 5A:
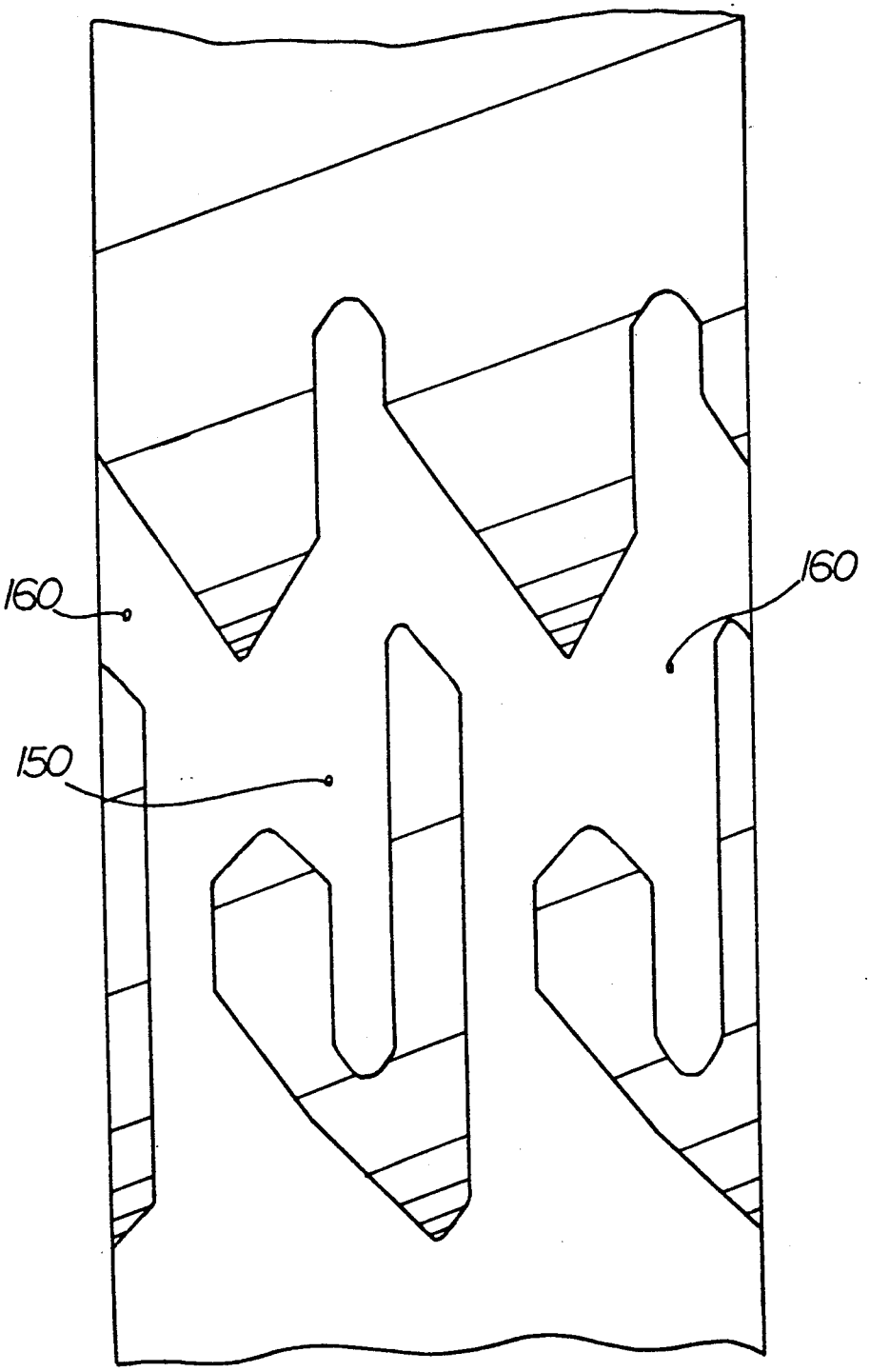
FIGS. 5*a*, 5*b*, and 5*c* are development views of the interior of the preferred embodiment of the downhole connection retrieving head box connector interior cylindrical surface, each showing two continuous grooves in a flat pattern plan view which represents how the interior cylindrical surface of the retrieving head box connector would appear if split longitudinally on one side and then rolled open, or laid out flat.
Figure 5B:
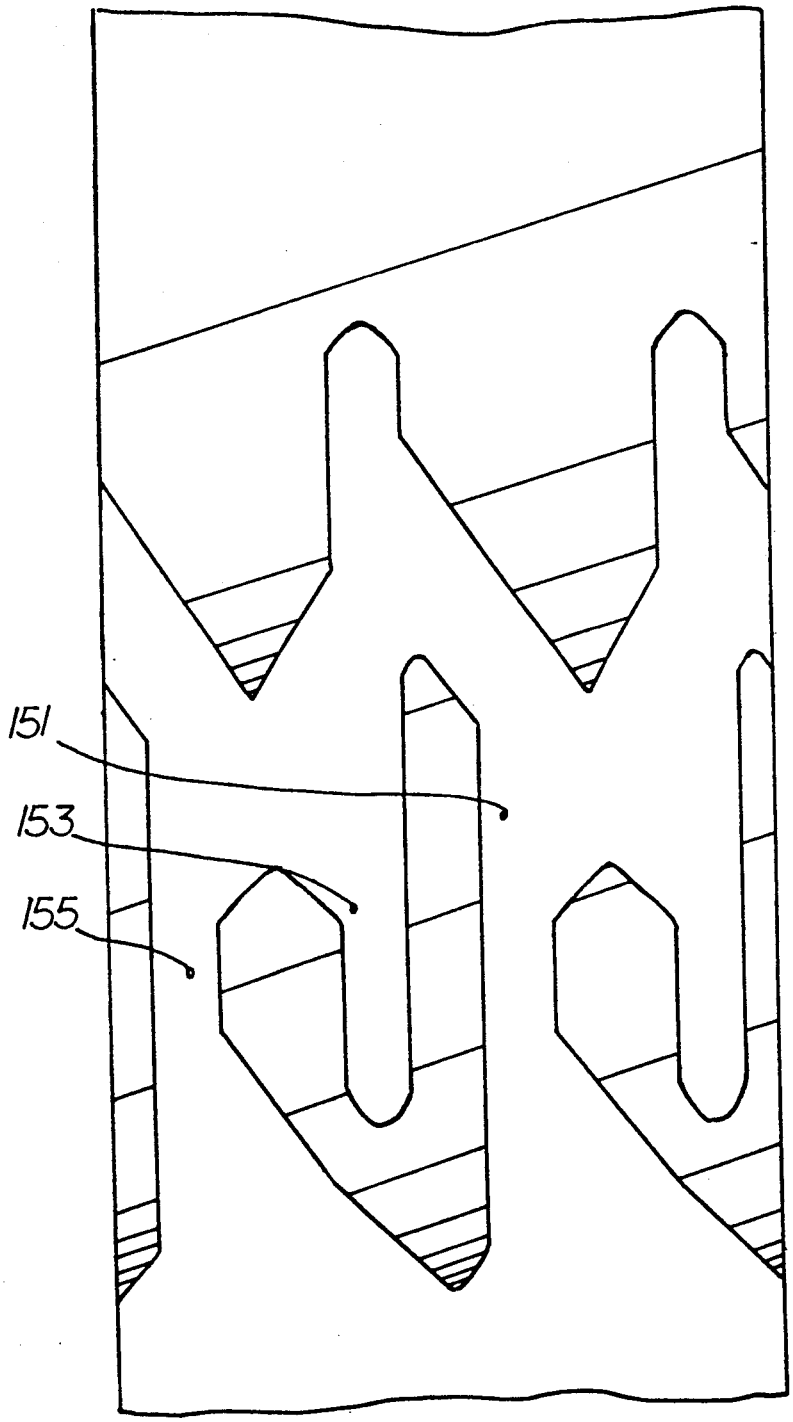
Figure 5C:
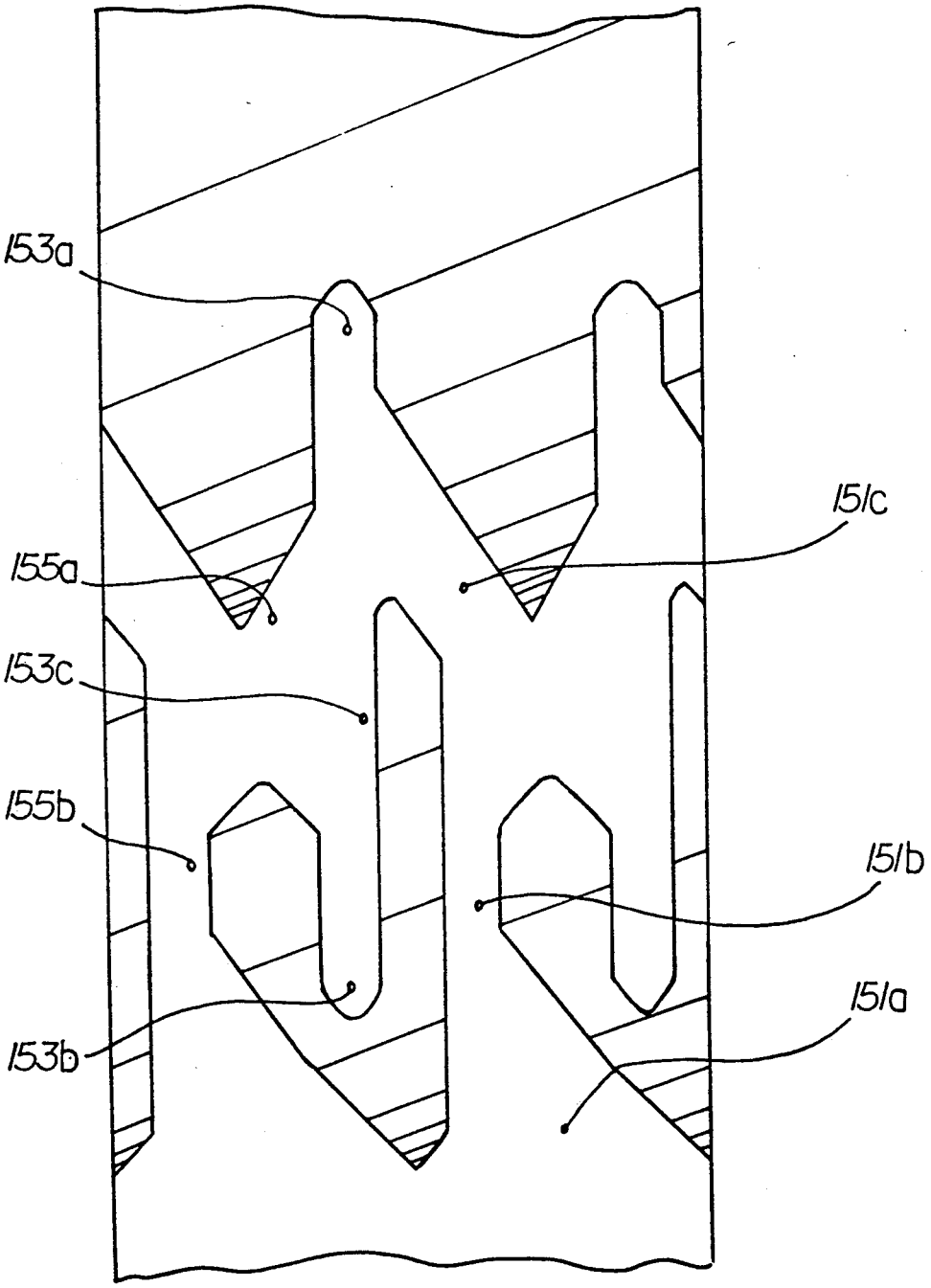

Now referring to FIGS. 5*a*, 5*b*, and 5*c*, a development view of the interior of the preferred embodiment of retrieving head box connector 102 is shown in which the two continuous grooves 150, 160 of box connector 102 are shown in a flat pattern plan view, which represents how the interior cylindrical surface of retrieving head box connector 102 would appear if split longitudinally on one side and then rolled open, or laid out flat. Although the preferred embodiment of this invention includes a pin connector 104 having two lugs 107 and 109, and a box connector 102 having two continuous grooves 150 and 160, other embodiments of this invention may include only one continuous groove and one lug, or a plurality of continuous grooves and lugs. In fact, the number of lugs and number of continuous grooves need not be the same, so long as the lugs are circumferentially disposed so that they will traverse into at least part of the continuous grooves to matingly engage a box connector and a pin connector to releasably couple a workstring with a wellbore tool so that torque and axial forces may be transmitted from the workstring to the wellbore tool.

With reference to FIG. 5*a* and the preferred embodiment of this invention, continuous grooves 150 and 160 provide a set of tracks, or pathways, for mating lugs, such as lug 107 and lug 109 on pin connector 104, to traverse to matingly engage box connector 102 with pin connector 104. While one of the lugs 107, or 109 are in continuous grooves 150, 160, they will traverse into different slots, or regions, within continuous grooves 150, 160 for different types of mating engagement.

Referring to FIG. 5*b*, continuous groove 150 is comprised of engagement groove 151, transmission groove 153, and disengagement groove 155. Engagement groove 151 is an entrance region for lug 107 to pass through to enter into mating engagement with continuous groove 150. Transmission groove 153 is a locking region for lug 107 to lock into mating engagement within continuous groove 150 for transmission of torque and axial forces. Disengagement groove 155 is an exit region through which lug 107 exits from mating engagement with continuous groove 150.

During operation of downhole connection 100 to matingly engage box connector 102 with pin connector 104, the component grooves of continuous grooves 150, 160 interact with different surfaces of either lug 107 or lug 109. For example, if lug 107 is matingly engaged within continuous groove 150, load is transferred from peripheral edge surfaces 143*p* and 145*p*, shown in FIG. 4, which form the sides of continuous groove 150, to the peripheral edge surface 107*p* of lug 107, shown in FIG. 2*b*, which forms load bearing surfaces 111, 113, 115, 117, 119, 121, 123, and 125, shown in FIG. 2*b*.

These different load bearing surfaces of lug 107 matingly engage within continuous groove 150 by either sliding along, or being pressed by, the peripheral edge surfaces 143*p* and 145*p* of continuous groove 150. During such mating engagement, only a portion of the load bearing surfaces of lug 107 touch the peripheral edge surfaces 143*p* and 145*p* at a time. The following discusses different combinations of lug 107 surfaces interacting within the component grooves of continuous groove 150. However, it should be remembered that usually only a portion of these lug surfaces mentioned below will touch the different peripheral edge surfaces 143*p* and 145*p* of continuous groove 150 at the same time.

Referring to FIG. 5*c*, engagement groove 151 is comprised of a locating slot 151*a*, insertion slot 151*b*, and an entrance slot 151*c*. When lug 107 (not shown in FIG. 5*c*) is matingly engaged with continuous groove 150, locating slot 151*a* serves to mate with locating and guide surfaces 111, 113, and 125 of lug 107, which are shown in FIG. 2*b*, to locate lug 107 with respect to continuous groove 150 and guide lug 107 into engagement with engagement groove 151. Insertion slot 151*b* provides a pathway for lug surfaces 115, and 123 to follow as lug 107 is inserted further into continuous groove 150. Entrance slot 151*c* acts in combination with locate and guide surfaces 117 and 125 of lug 107, which are shown in FIG. 2*b*, to both provide a pathway and guide surfaces for directing lug 107 into transmission groove 153.

Still with reference to FIG. 5*c*, transmission groove 153 is comprised of push and torque slot 153*a*, pull and torque slot 153*b*, and traversing slot 153*c*. Traversing slot 153*c* serves as a pathway for a matingly engaging lug, such as lug 107, to move within when traversing between push and torque slot 153*a*, pull and torque slot 153*b*, engagement groove 151, and disengagement groove 155.

For example, when lug 107 is engaged within continuous groove 150, push and torque slot 153*a* matingly engages with lug 107 at lug surfaces 111, 113, 115, 123, and 125. Downward axial forces from workstring W are transmitted to wellbore tool T by push and torque slot 153*a* acting on lug 107 to transmit downward force to at least a portion of lug surfaces 111, 113, and 125, which serve as load bearing surfaces to receive this downward force which urges wellbore tool T downward. Right-hand torque is transmitted by push and torque slot 153*a* pressing on at least a portion of lug surfaces 111, 113, and 115 which serve as load bearing surfaces for receiving load when right-hand torque is applied by workstring W to wellbore tool T. Left-hand torque is transmitted from workstring W to wellbore tool T by slot 153*a* pressing against at least a portion of lug surfaces 111, 123, and 125, which act as load bearing surfaces for receiving left-hand torque.

Pull and torque slot 153*b* presses against at least a portion of lug surfaces 117, 119, and 121 to transmit upward forces to pin connector 104 which pull upward on wellbore tool T to urge it uphole. Pull and torque slot 153*b* also presses against at least a portion of lug surfaces 115, 117, and 119, which serve as load bearing surfaces for receiving right-hand torque from pull and torque slot 153*b*. Pull and torque slot 153*b* transmits left-hand torque to lug 107 by pressing against at least a portion of surfaces 119, 121, and 123, which serve as load bearing surfaces for receiving left-hand torque from pull and torque slot 153*b*.

Disengagement groove 155 is comprised of exit slot 155*a* and removal slot 155*b*. Removal slot 155*a* acts in connection with at least a portion of lug surfaces 111, 113, 117, 119, and 121 to locate and guide lug 107 as it moves from transmission groove 153 into disengagement groove 155. Removal slot 155*b* serves as a pathway, or track, for lug 107 to travel as it is disengaged, or removed, from continuous groove 150. Removal slot 155*b* acts in connection with at least a portion of lug surfaces 115, and 123.

It should be noted that in the preferred embodiment of the invention, engagement groove 151 of continuous groove 150 also serves as the disengagement groove for second continuous groove 160. Also note that disengagement groove 155 of continuous groove 150 serves as an engagement groove for second continuous groove 160 in the preferred embodiment of this invention. In other embodiments of this invention, adjacent continuous grooves, or tracks, need not share common sections, but may be totally separate continuous grooves.

Figure 6:
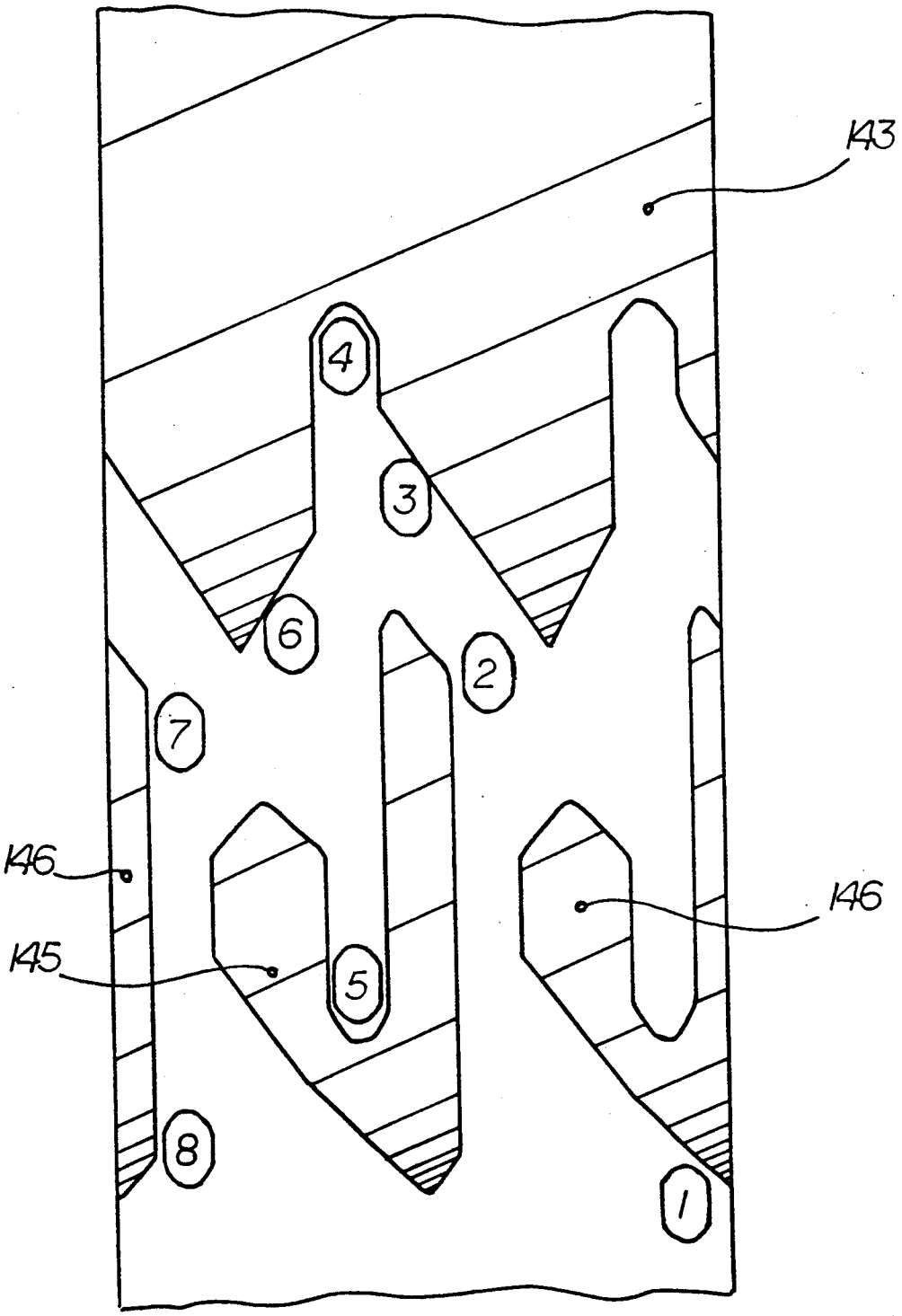
FIG. 6 is the development view of FIGS. 5*a*, 5*b*, and 5*c*, showing a schematic diagram of a lug in various positions in mating engagement within one of the continuous grooves of the retrieving head box connector as the workstring and wellbore tool are coupled, manipulated to transfer torque and axial force, and then uncoupled.

Operation of the downhole tool 100 retrieving head 101 to couple workstring W to wellbore tool T is illustrated in FIG. 6, which is the development view of FIGS. 5*a*, 5*b*, and 5*c* showing a schematic diagram of lug 107 in various positions within continuous groove 150 as the retrieving head box connector 102 is lowered over, and then later removed from pin connector 104. These various positions of lug 107 in continuous groove 150 are labeled 1 through 8.

Referring again to FIG. 1, workstring W is matingly engaged with wellbore tool T by lowering box connector 102, which serves as a female lock piece, over pin connector 104, which serves as a male lock piece, as wellbore tool T is rigidly disposed inside of casing C downhole in the wellbore. As box connector 102 is moved to cover pin connector 104, lug 107 (not shown) is inserted into continuous groove 150 (not shown). In the preferred embodiment of the present invention, lug 107 is stationery as groove 150 moves over lug 107 to couple workstring W tool to wellbore tool T. Positions 1 through 8 of FIG. 6 represent different positions of lug 107 as continuous groove 150 moves over lug 107.

Referring to FIG. 6, position 1 shows lug 107 at locating slot 151*a* when it is entering into engagement groove 151. Position 2 shows lug 107 at the junction of insertion slot 151*b* and entrance slot 151*c* of engagement groove 151. Position 3 shows lug 107 engaged within entrance slot 151*c* as it approaches transmission groove 153. Position 4 shows lug 107 in push and torque slot 153*a*. Position 5 shows lug 107 in pull and torque slot 153*b*. Position 6 shows lug 107 after it has left traversing slot 153*c* and has engaged within one end of exit slot 155*a* of disengagement groove 155. Position 7 shows lug 107 in disengagement groove 155 at the junction of exit slot 155*a* and removal slot 155*b*. Position 8 shows lug 107 at the lower end of removal slot 155*b*, with lug 107 disengaging from continuous groove 150 as retrieving head box connector 102 is removed from pin connector 104.

With reference to FIG. 6, lug 107 begins engagement into continuous groove 150 at position 1 where locating slot 151*a*, shown in FIG. 5*c*, positions box connector 102 so that continuous groove 150 will be guided into engagement over lug 107. As box connector 102 is lowered further over pin connector 104, continuous groove 150 moves over lug 107 so that lug 107 is inserted further into continuous groove 150 to position 2 of FIG. 6. Further movement of box connector 102 over pin connector 104 will cause lug 107 to be moved from position 2 to position 3 of FIG. 6. Insertion of lug 107 into continuous groove 150, which is shown as lug 107 travels from position 1, to position 2, to position 3, then to position 4, will occur automatically as box connector 102 is lowered over pin connector 104 in the preferred embodiment of this invention, without application of right-hand torque through workstring W. Engagement groove 151 is shaped so that right-hand torque will automatically be applied to box connector 102 as workstring weight is applied from box connector 102 to pin connector 104, which is affixed to wellbore tool T in this preferred embodiment of the present invention.

Once box connector 102 is engaged with pin connector 104, workstring W may be either raised or lowered to move box connector 102 either upward or downward over pin connector 104 to cause lug 107 to traverse in transmission groove 153 between positions 4, and 5. Also, the weight of workstring W may be either picked up or slacked off to apply axial loads to wellbore tool T by transmission of these forces through transmission groove 153 of box connector 102 to lug 107 of pin connector 104. Workstring W may also be rotated to transmit torque to wellbore tool T through lugs 107 and 109 when they are in either position 4 or 5 in grooves 150 and 160. Torque and axial forces are also transmitted by engagement between continuous groove 160 and lug 109.

For example, as box connector 102 is lowered over pin connector 104, lug 107 travels into position 4 to couple box connector 102 with pin connector 104 so that downward axial forces may be applied to push on wellbore tool T. In addition, both right-hand and left-hand torque may be applied through workstring W and downhole connection 100 to wellbore tool T. Workstring W may also be pulled upward to move lug 107 into position 5 where lug 107 is shown engaged in pull and torque slot 153*b*, to couple upward axial forces between workstring W and wellbore tool T. Also, right and left-hand torque may be applied to wellbore tool T when lug 107 is engaged in pull and torque slot 153*b*.

To disengage box connector 102 from pin connector 104, box connector 102 is set down on pin connector 104 to place lug 107 in position 4, right-hand torque is applied to workstring W at the surface, and the workstring is raised until lug 107 is moved from position 4, to position 6, and into position 7. Torque may be applied at the surface of the wellbore to workstring W with a long handled pipe wrench (not shown) until lug 107 is felt to bump up into position 7 in disengagement groove 155. For example, from position 4, the workstring would be picked up, or raised, as torque is applied at the surface with the pipe wrench. An operator at the surface applying torque with a pipe wrench to the workstring will feel a solid bump when the side of disengagement groove 155 bumps up against lug 107 surface 115 (not shown). Once lug 107 is felt to have bumped up at position 7, the workstring may be picked up to pull box connector 102 off of pin connector 104. Position 8 shows pin connector 102 as it is disengaging from continuous groove 150.

In the preferred embodiment of this invention, it is best to disengage lug 107 from transmission groove 153 to disengagement groove 155 by picking up workstring W. Otherwise, lug 107 will tend to automatically engage within second continuous groove 160 when the weight of workstring W is set down onto wellbore tool T, just as it initially tracked into continuous groove 150 in traversing from position 1 to position 2 to position 4.

It should be noted that in the preferred embodiment, position 1 of FIG. 6 showing continuous groove 150 engaging lug 107 corresponds with position 8 of second continuous groove 160 disengaging lug 109. Position 2 showing continuous groove 150 over lug 107 corresponds to position 7 showing second continuous groove 160 engaging lug 109. Stated another way, the engagement groove 151 for continuous groove 150 serves as a disengagement groove for second continuous groove 160, and disengagement groove 155 of continuous groove 150 serves as an engagement groove for second continuous groove 160. However, other embodiments of this invention are possible wherein adjacent continuous grooves would not necessarily share grooved surfaces. Also, there may be only one lug and a plurality of continuous grooves. In other forms of this invention, groove connections may be made by other methods than installing and fastening inserts, such as insert 145 and insert 143, within a retrieving head. Also, a pin connector with circumferentially disposed lugs could be located at the lower end of a workstring, and a box connector could be located on the upper end of the wellbore tool.

Thus, the present invention has an advantage over prior art downhole connections, since the present invention may be operated without requiring application of left-hand torque to the workstring.

While the invention has been shown in only one of its forms, it is not thus limited but is susceptible to various changes and modifications without departing from the spirit thereof.

What is claimed is:

1. A connection for use in a wellbore to matingly and releasably engage a workstring to a wellbore tool, said connection comprising:

a plurality of torque members for transmitting torque from said workstring through said connector to said wellbore tool; and a plurality of engagement members for engaging and disengaging said workstring and said wellbore tool in response to, at least in part, a unidirectional rotation of said workstring applied to said connector.

2. The connection of claim 1, wherein said plurality of torque members for transmitting torque to said wellbore tool include:

at least one torque receiver surface which defines a lower portion of said connection disposed on an upper end of said wellbore tool and provides a load bearing surface;

at least one torque transmitter surface which defines an upper portion of said connection disposed on the lower end of said workstring, matingly engages said torque receiver surface, and provides a load transmitting surface wherein said torque transmitter surface engages said load bearing surface to enable torque transference therebetween.

3. A connection for use in a wellbore to matingly engage a workstring to a wellbore tool in order to transmit torque and axial force from said workstring to said wellbore tool disposed inside of said wellbore, wherein said connection is capable of engaging said workstring to said wellbore tool and disengaging said workstring from said wellbore tool when said wellbore tool is disposed downhole inside of said wellbore, said connection comprising:

a first connector half which has at least one first connector protruding member;

a second connector half which has at least one second connector protruding member disposed for providing a mating engagement with said at least one first connector protruding member on said first connector half to matingly engage with said first connector half; and wherein said second connector half and said first connector half are engaged in said mating engagement and disengaged from said mating engagement, at least in part, by a rotation in one angular direction.

4. The connection of claim 3, wherein said first connector protruding member outwardly protrudes from said first connector half in an outward radial direction generally orthogonal to a longitudinal axis of said wellbore tool;

wherein said second connector protruding member inwardly protrudes from said second connector half in an inward radial direction generally orthogonal to said longitudinal axis of said wellbore tool;

wherein said first connector member has a first generally cylindrical shape;

wherein said second connector member has a second generally cylindrical shape, and is concentrically disposed around said first connector member when joined therewith in said mating engagement; and wherein said direction of rotation in one angular direction is right-hand rotation.

5. A connection for use in a wellbore to matingly engage a workstring to a wellbore tool in order to transmit torque and axial force from said workstring to said wellbore tool, wherein said connector is capable of matingly engaging said workstring to said wellbore tool and disengaging said workstring from said wellbore tool while said wellbore tool is inside of said wellbore, said connection comprising:

an inner connector half which has at least one outwardly protruding member;

an outer connector half which has at least one inwardly protruding member for matingly engaging said at least one outwardly protruding member on said inner connector half, wherein said inner connector half and said outer connector half are engaged and disengaged, at least in part, by a rotation in one angular direction.

6. The connection of claim 5, wherein said inner connector half is an upward looking pin attached to said wellbore tool and said at least one outwardly protruding member is a generally diamond shaped lug;

wherein said outer connector half is a downward looking box connection defining a retrieving head which is cylindrical in shape and attached to the lower end of said workstring;

wherein said at least one inwardly protruding member defines, at least in part, a grooved inner surface of said cylindrical member for matingly engaging said generally diamond shaped lug of said upward looking pin; and wherein said upward looking pin is disposed concentrically within said box connection defining a retrieving head when matingly engaged therewith.

7. The connection of claim 5, wherein said rotation in one angular rotation is right-hand rotation.

8. A retrieving head for use in a wellbore to transmit torque and axial force from a workstring to a wellbore tool, wherein said retrieving is head disposed on the lower end of said workstring and is capable of disengaging from and matingly engaging with said wellbore tool when said wellbore tool is located downhole inside of said wellbore, said wellbore tool including an uppermost portion defining a pin connector which has at least one lug for matingly engaging said retrieving head, said retrieving head comprising:

a box connector which has an interior cylindrical surface with at least one continuous combination of grooves disposed therein, said at least one continuous combination of grooves including:

a transmission groove which matingly engages with said pin connector to provide a coupling for transmitting torque and axial force;

an engagement groove which matingly engages with said pin connector to provide a pathway for said at least one lug to traverse into said transmission groove; and a disengagement groove which matingly engages with said pin connector to provide a pathway for said at least one lug to traverse outward from said transmission groove, wherein said disengagement groove is disposed on an opposite circumferential side of said transmission groove from said engagement groove.

9. The retrieving head of claim 8, wherein said a box connector interior cylindrical surface is comprised of a plurality of said at least one continuous combination of grooves disposed therein; and wherein each said engagement groove is at least in part defined by a plurality of surfaces which define an adjacent disengagement groove of an adjacent one of said plurality of said at least one continuous combination of grooves.

10. The retrieving head of claim 8, wherein said engagement groove includes: a locating slot for positioning said at least one lug with respect to said engagement groove to allow insertion into said retrieving head, an insertion slot for providing a path for said at least one lug to travel when inserted into said retrieving head, and entrance slot for providing a path for said at least one lug to travel into said transmission groove;

wherein said transmission groove includes: a pull and torque slot for providing a mating engagement with said at least one lug so that a combination of pull axial forces and torque can be transmitted from said workstring to said wellbore tool, a push and torque slot for providing a mating engagement with said at least one lug so that a combination of push axial forces and torque can be transmitted from said workstring to said wellbore tool, and a traversing slot for providing a path for said at least one lug to move between said push and torque slot to said pull and torque slot, and to in part retain said at least one lug within said transmission groove; and wherein said disengagement groove includes: an exit slot for providing a path for said at least one lug to travel in order to exit from said transmission groove, and a removal slot for providing a path for said at least one lug to travel axially when removed from said retrieving head.

11. A retrieving head for use in a wellbore to transmit torque and axial force from a workstring to a wellbore tool, said retrieving head disposed on the end of a workstring and capable of disengaging from and matingly engaging with said wellbore tool when said wellbore tool is located downhole inside of said wellbore, said wellbore tool including an uppermost portion defining a pin connector which has at least one lug for matingly engaging said retrieving head, said retrieving head comprising:

a box connector which has an interior cylindrical surface with at least one continuous combination of grooves disposed therein, said at least one continuous combination of grooves including:

a transmission groove which matingly engages with said pin connector to provide a coupling for transmitting torque and axial force;

an engagement groove which matingly engages with said pin connector to provide a pathway for said at least one lug to traverse into said transmission groove; and a disengagement groove which matingly engages with said pin connector to provide a pathway for said at least one lug to traverse outward from said transmission groove, wherein said disengagement groove is disposed on an opposite circumferential side of said transmission groove from said engagement groove;

said engagement groove, which is part of said at least one continuous groove, including:

a locating slot which is at least in part defined by a pair of diagonally circumferentially converging opposing locating slot guide surfaces;

an insertion slot which is at least in part by defined a pair of parallel circumferentially opposing insertion slot guide surfaces; and an entrance slot which is at least in part defined by a pair of parallel diagonal opposed entrance slot guide surfaces which continuously connect said engagement groove to said transmission groove;

said transmission groove, which is part of said at least one continuous groove, including:

a pull and torque slot which is at least in part defined by a lower left-hand torque transmitter surface, a lower right-hand torque transmitter surface, and a pull transmitting surface;

a push and torque slot at least in part defined by an upper left-hand torque transmitter surface, an upper right-hand torque transmitter surface, and a push transmitting surface;

a traversing slot which is at least in part defined by a plurality of traversing slot guide surfaces which at least in part provide a pathway between said pull and torque slot and said push and torque slot, and at least in part provide a retention members for retaining said at least one lug in mating engagement within said transmission groove;

wherein said upper left-hand torque transmitter surface, said upper right-hand torque transmitter surface, said pull transmitting surface, said lower left-hand torque transmitter surface, said lower right-hand torque transmitter surface, are load transmitting surfaces, and said lower push transmitting surface define a plurality of load bearing surfaces which matingly engage with a plurality of load receiver surfaces defining said push receiving surface, said pull receiving surface, said left-hand torque receiver surface, and said right-hand torque receiver surface of at least one of said at least one lug;

said disengagement groove, which is part of said at least one continuous groove, including:

an exit slot which is at least in part defined by a plurality of exit slot guide surfaces;

a removal slot which is at least in part defined by a plurality of removal slot guide surfaces, wherein at least one of said removal slot guide surfaces is disposed to stop right-hand rotation of said retrieving head upon removal of one of said at least one lug from said transmission groove.

12. The apparatus of claim 11, wherein a plurality of groove surfaces, which at least in part define said at least one continuous combination of grooves, are themselves defined by a plurality of edge surfaces of at least one pair of inserts which fasten to the interior of said box connector housing to at least in part define said interior cylindrical surface with at least one continuous combination of grooves.

13. The retrieving head of claim 11, wherein said at least one lug on said pin connector includes:

a pull receiving surface for receiving a pull force from said retrieving head, wherein said pull force urges said wellbore tool towards an uphole direction;

a push receiving surface for receiving a push force from said retrieving head, wherein said push force urges said wellbore tool towards a downhole direction;

a right-hand torque receiver surface for receiving right-hand torque from said retrieving head, wherein said right-hand torque urges said wellbore tool towards right-hand rotation;

a left-hand torque receiver surface for receiving left-hand torque from said retrieving head, wherein said left-hand torque urges said wellbore tool towards left-hand rotation;

a pair of longitudinally opposed pointed ends for guiding said at least one lug into said at least one continuous combination of grooves in said interior cylindrical surfaces of said retrieving head, wherein said pair of longitudinally opposed pointed ends at least in part define said pull receiving surface and said push receiving surface to provide at least part of a push and pull force transmission coupling when matingly engaged within said at least one grooved interior cylindrical surface disposed inside of said retrieving head; and a set of circumferentially opposed lateral flats which at least in part define said right-hand torque receiver surface and said left-hand torque receiver surface to provide at least part of a torque transmission coupling when matingly engaged within said at least one grooved interior cylindrical surface disposed inside of said retrieving head.

14. A connection for use in a wellbore to releasably couple a wellbore tool to a workstring, said workstring used for conveyance and manipulation of said wellbore tool, said connection comprising:

a first lock piece which includes a cylindrical track defined between an inner cylindrical wall and an outer cylindrical wall;

a second lock piece which includes at least one lug extending radially form a cylindrical body defining in part said second lock piece;

said cylindrical track, which is disposed between said inner cylindrical wall and said outer cylindrical wall, releasably engaging said at least one lug to interconnect said first lock piece with said second lock piece, and said cylindrical track including:

an entrance region which is both a longitudinally and circumferentially extending track;

an exit region which is both a longitudinally and circumferentially extending track; and a locking region which is a longitudinally extending track disposed between said entrance region and said exit region.

15. The connection of claim 14, wherein said first lock piece defines a lower region of said workstring which is formed as a female locking member, and said second lock piece defines an upper region of said wellbore tool which is formed as a male locking member which releasably interconnects said female locking member by said at least one lug which extends radially outward from said second lock piece to releasably engage said cylindrical track of said first lock piece.

16. A connection for use in a wellbore to releasably couple a wellbore tool to a workstring, said workstring used for conveyance and manipulation of said wellbore tool, said connector comprising:

a male lock piece which is disposed on the upper portion of said wellbore tool. defines said upper portion of said wellbore tool and includes at least one lug which extends radially outward from a cylindrical body which in part defines said male lock piece;

a female lock piece which is disposed on the lower end of said workstring, which defines said lower end of said workstring, which releasably interconnects with said male lock piece, said female lock piece including a cylindrical track defined between an inner cylindrical wall and an outer cylindrical wall and which matingly engages with one of said at least one lug disposed on said male lock piece, said cylindrical track defined by:

an entrance region, which allows engagement of said male lock piece and said female lock piece by setting down at least part of said workstring load upon said wellbore tool, wherein said one of said at least one lug disposed on said male lock piece engages with said entrance region and is inserted into said cylindrical track;

an exit region, which allows disengagement of said male lock piece and said female lock piece by picking up on said workstring load and applying clockwise torque to said workstring, wherein said one of said at least one lug disposed on said male lock piece disengages from said exit region and is removed from said cylindrical track at least in part by application of clockwise rotation to said workstring; and a locking region which allows upward and downward movement of said workstring without disengagement of said male lock piece and said female lock piece, and which further allows clockwise and counterclockwise rotation of said workstring and tool without disengagement of said male lock piece and said female lock piece, wherein only a combination of axial and rotational movement of said workstring allows disconnecting of said male lock piece and said female lock piece, wherein said one said at least one lug disposed on said male lock piece remains engaged with and inserted within said cylindrical track to receive axial force and torque from said cylindrical track.

17. A connection for use in a wellbore to releasably couple a wellbore tool to a workstring, said workstring used for conveyance and manipulation of said wellbore tool, said connection comprising:

a male lock piece which defines an upper portion of said wellbore tool and includes at least one male lock piece lug which extends radially outward from a cylindrical body which in part defines said male lock piece;

a female lock piece which defines a lower end of said workstring and releasably interconnects with said male lock piece, said female lock piece including a cylindrical track defined between an inner cylindrical wall and an outer cylindrical wall which matingly engages with one of said at least one male lock piece lug;

said cylindrical track, which is disposed on the inner surface of said female lock piece, including:

an entrance region which is both a longitudinally and circumferentially extending track;

an exit region which is both a longitudinally and circumferentially extending track; and a locking region which is a longitudinally extending track disposed between said entrance region and said exit region.

18. The connection of claim 17, wherein said connector is operable in a plurality of modes which include:

a first engagement mode wherein said male lock piece and said female lock piece are engaged by setting down at least part of said workstring load upon said wellbore tool, wherein said one of said at least one male lock piece lug engages with said entrance region and is inserted into said cylindrical track;

a second engagement mode wherein said male lock piece and said female lock piece are engaged by rotating said workstring in a clockwise direction once said female lock piece is lowered over said male lock piece, wherein said one of said at least one male lock piece lug engages with said entrance region and is inserted into said cylindrical track;

an upward movement within said locking region mode wherein said female connector piece is moved upward over said male connector piece and said one of said at least one male lock piece lug engaged with and inserted into said longitudinally track of said locking region of said cylindrical track;

a downward movement within said locking region mode wherein said female connector piece is moved downward over said male connector piece and said one of said at least one male lock piece lug remains engaged with and inserted into said longitudinally extending track of said locking region of said cylindrical track;

a first transmission mode wherein said workstring pulls on said wellbore tool and turns with clockwise rotation to apply an upward axial force and clockwise torque to said wellbore tool, wherein said one of said at least one male lock piece lug remains engaged with and inserted into said cylindrical track;

a second transmission mode wherein said workstring pulls on said wellbore tool and turns counterclockwise rotation to apply an upward axial force and counterclockwise torque to said wellbore tool, wherein said one of said at least one male lock piece lug remains engaged with and inserted into said cylindrical track;

a third transmission mode wherein said workstring pushes on said wellbore tool and turns with clockwise rotation to apply a downward axial force and clockwise torque to said wellbore tool, wherein said one of said at least one male lock piece lug remains engaged with and inserted into said cylindrical track;

a fourth transmission mode wherein said workstring pushes on said wellbore tool and turns with counterclockwise rotation to apply said downward axial force and counterclockwise rotation to said wellbore tool, wherein said one of said at least one male lock piece lug remains engaged with and inserted into said cylindrical track; and a disengagement mode wherein said male lock piece and said female lock piece are disengaged by picking up on said workstring load from said wellbore tool and applying clockwise torque to said workstring, wherein said one of said at least one male lock piece lug disengages from said exit region and its removed from said cylindrical track.

* * * * *